United States Patent [19]

Knoop

[11] 4,437,854

[45] Mar. 20, 1984

[54] TAPE ROLL HOLDER HAVING TAB FORMING DEVICE

[76] Inventor: Jack P. Knoop, 326 Avenida Arboles, San Jose, Calif. 95123

[21] Appl. No.: 294,533

[22] Filed: Aug. 20, 1981

[51] Int. Cl.[3] ..... B26F 3/02

[52] U.S. Cl. ..... 493/353; 493/419; 493/466; 225/25

[58] Field of Search ..... 493/466, 419; 225/14, 225/21, 22, 24, 25, 34; 156/523, 527, 530, 577; 267/158, 164

[56] References Cited

U.S. PATENT DOCUMENTS

| | | | |
|---|---|---|---|
| 2,264,425 | 12/1941 | Witter | 225/21 |
| 2,300,423 | 11/1942 | Holben | 225/25 |
| 2,463,445 | 3/1949 | Van Cleef | 225/21 |
| 2,506,504 | 5/1950 | Hudson | 225/21 |
| 2,676,658 | 4/1954 | King | 225/34 |
| 2,873,967 | 2/1959 | Larson | 225/24 |
| 2,899,198 | 8/1959 | Krueger | 493/419 |
| 3,148,748 | 9/1964 | Young | 267/164 |
| 3,521,800 | 7/1970 | Stephens et al. | 225/25 |

FOREIGN PATENT DOCUMENTS

| | | | |
|---|---|---|---|
| 2232663 | 2/1973 | Fed. Rep. of Germany | 225/25 |

*Primary Examiner*—Nicholas P. Godici
*Assistant Examiner*—Kurt Rowan
*Attorney, Agent, or Firm*—Yoshio Katayama

[57] ABSTRACT

A tape dispenser with a tab forming device which includes a pair of upwardly extending forward and rearward struts joined at lower extremities within a cylindrical slotted spring which limits maximum separation of the struts. Upper extremities of the struts are terminated in two wings which, when brought together, cause a tape loop to be made, forming a tape tab. The rearward strut is adapted with a downwardly extending leg and foot for being secured within a tape roll holder, while the forwardly extending strut is adapted with an inverted hook over the wing at the upper extremity of the strut. The hook includes a forward serrated edge for tearing tape. The entire construction may be molded as a unitary article.

1 Claim, 4 Drawing Figures

TAPE ROLL HOLDER HAVING TAB FORMING DEVICE

DESCRIPTION

TECHNICAL FIELD

The invention relates to tape dispensing apparatus and in particular to tape dispensing apparatus wherein tape tabs are formed at the head of a tape section to be dispensed.

BACKGROUND ART

Tape tab forming devices are known. For example, U.S. Pat. No. 2,300,423 to H. Holben shows a tape roll holder having an arm actuated rocking member upon which tape normally rests. By pushing the arm downwardly, the rocking member moves back toward a tear-off station where a tape tab is formed by a loop of tape which comes together.

In U.S. Pat. No. 2,526,494 to G. McNeil a spring arm within a tape roll holder moves back and forth for the purpose of forming tape tabs.

In U.S. Pat. No. 3,204,949 H. Kieslich discloses a cam actuated set of rollers which form tape tabs in a tape dispenser.

These and other patents illustrate the utility of tape tabs associated with tape roll holders. However, many prior art devices are characterized by mechanical complexity which precludes the use of tape tab forming devices in low-cost, plastic tape dispensers.

An object of the present invention was to devise a tape dispenser including a tape tab forming device, which is characterized by a simplified low-cost construction which could be executed by molding, preferably with a single member.

DISCLOSURE OF INVENTION

The above object has been achieved by providing a simple tape tab forming device which can be constructed as a unitary member and housed within existing plastic tape dispensers or dispensers of similar construction. The tab forming member is characterized by a pair of upwardly extending forward and rearward struts having upper extremities terminating in wings. The lower extremities of the struts are connected together within a cylindrical spring which limits the outward spreading of the struts. The wings provide support tables in the tape dispensing path so that a section of tape may be supported in two places and brought together to form a tab by self-adherence of the tape near the wings. This requires that the struts be pushed together to a closed position, bringing the wings into a wing-to-wing abutting relation. The rearward strut may be provided with a downwardly extending leg and foot which is adapted to engage anchor members in a plastic tape roll holder. Normally, such anchor members secure a metal hook for tearing tape. Instead, a tape tearing hook is connected to the forward strut, extending over the top of the forward wing and having a cantilevered forward serrated edge in the tape path for tearing tape.

Such a tape tab forming device is simple and may be adapted to existing tape roll holder constructions, especially a widely used construction having split halves. The tape tab forming device may also be incorporated in other roll holders since it is easily connected to a tape tear-off station.

BEST MODE FOR CARRYING OUT THE INVENTION

Figure 1:
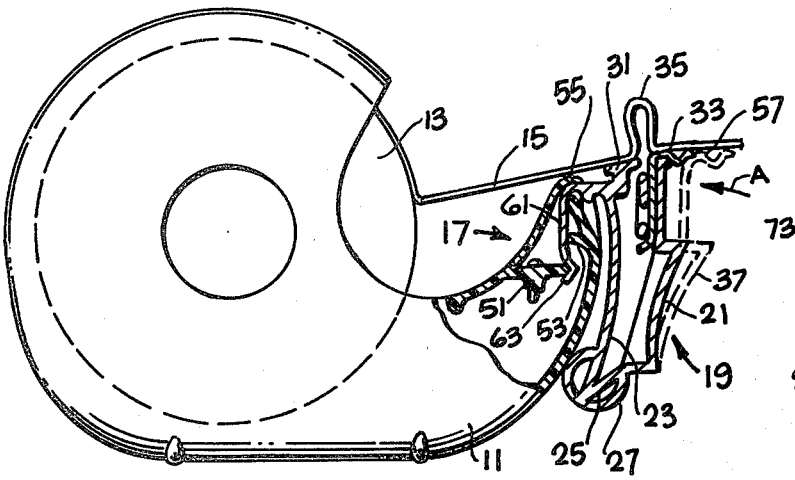
FIG. 1 is a side plan view of a tape dispenser with the tape tab forming device of the present invention connected thereto.

With reference to FIG. 1 a tape dispenser may be seen with two major assemblies. A first major assembly is the roll holder 11 which supports the tape roll 13. This roll contains pressure sensitive tape with an adhesive backing on one side. A terminal span 15 of the tape is guided in a tape path toward the upwardly extending tear-off station 17. This type of roll holder and tear-off station are known in the prior art and are especially popular because of low cost and convenience. Such a roll holder is manufactured by Minnesota Mining and Manufacturing Co. While the present invention is shown for use with such a roll holder it is not restricted to such use and may be used with other roll holders.

Figure 2:
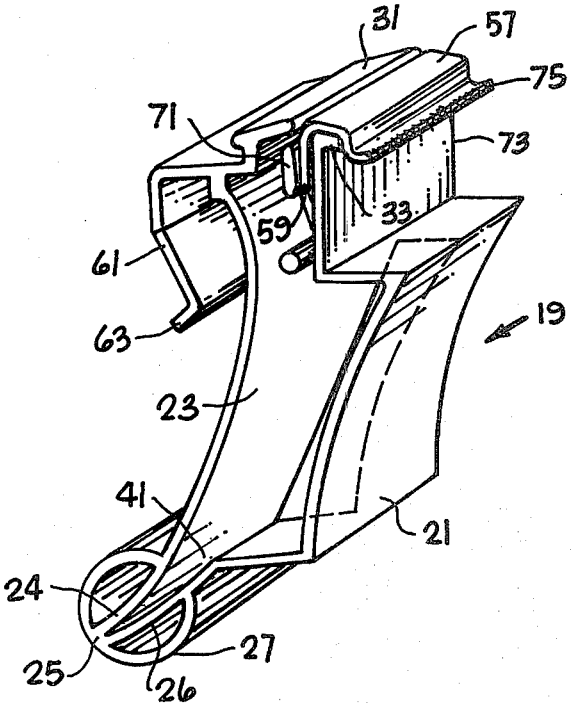
FIG. 2 is a perspective front view of the tape tab forming device of the present invention.

The second major assembly of the present invention, which may be viewed both in FIGS. 1 and 2, is the tape tab forming device 19 which is connected to the upwardly extending tear-off station 17. The tab forming device 19 is of essentially unitary construction, although a metal hook with a serrated metal tear-off edge may be added, as explained below. The principal members of the tape forming device 19 are the upwardly extending forward strut 21 and rearward strut 23. The lower extremities of these struts are joined at region 25 within cylindrical spring 27. The upper extremities of the struts terminate in wings 31 and 33 which are used to support tape portions in order to form the tape tab 35.

Operation of the tape tab forming device is indicated in FIG. 1 by the dashed lines 37 which indicate the normally open position of the struts 21 and 23. In operation, strut 21 is pushed backwards in a direction indicated by arrow A from the position indicated by the dashed lines 37 until a tape tab 35 is formed by bringing wings 31 and 33 into a wing-to-wing abutting relation, or approaching such a relation. This tab may then be grasped by a user and the tape pulled forward and torn off at a desired region.

The tape roll holder has a plurality of anchor members 51, 53. These anchor members are customarily provided in existing tape roll holders produced by Minnesota Mining and Manufacturing Co. for the purpose of retaining a metal hook with a serrated edge for tearing tape. In the prior art, this hook passed over the apex 55 of the tape tear-off station. However, in the present invention the metal hook is mounted over the wing 33 so that the serrated edge projects forwardly of wing 33, forming the most forward portion of the tape tab forming assembly. Apex 55 is not needed as a tape support region and could be eliminated. The strut 23 has a downwardly extending leg and foot which is secured by the anchor members 51 and 53. Specifically, the leg 61 is supported on one side by anchor member 53 and the lower extremity of the leg, namely foot 63 is supported on the opposite side by anchor member 51.

In FIG. 2, the cylindrical spring 27 is seen to have a lengthwise or axial slot 41 which allows the lower extremities 24 and 26 of the struts 21 and 23 to be joined at lower region 25 in a manner so that mutually inward force can be applied, thereby limiting the extent to which the struts 21 and 23 can be separated.

Figure 3:
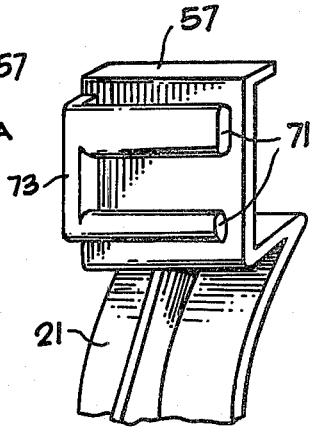
FIG. 3 is a perspective rear view of the upper extremity of a forward strut in the tape tab forming device of FIG. 2.

The upper region of the strut 21 may be seen to have a tape tearing hook. The shank 59 of the hook extends downwardly and is retained in a slot behind tangs 71 which are connected to strut 21 at region 73, illustrated in FIG. 3. The hook 57 has a forward serrated edge 75 which is used for tearing tape. The hook 57 may be of a conventional design, such as the tape tearing hook which is presently employed in tape roll dispensers sold by Minnesota Mining and Manufacturing Co. The hook may be metal or may be plastic. The entire tape tab forming assembly illustrated in FIG. 2 may be unitary, including the hook, or may be two-piece, where the second piece is a metallic hook 57, while the remainder of the body is molded from polymer material. The polymer material used should have sufficient rigidity to provide a springlike quality, resistance to flexing fatigue, and have low tendency to stress cracking. The class of polymeric materials known as acetal are well suited for purposes of the present invention. Within the general class of acetal, the following materials are particularly suitable: Delrin, manufactured by DuPont Chemicals and Celcon, manufactured by Celanese Chemicals. Of course, the assembly may be made of more than two pieces. For example, spring 27 may be a metal member and each of the struts 21 and 23 may be formed separately. However, for purposes of simplicity, a unitary or two-piece design is preferable.

Figure 4:
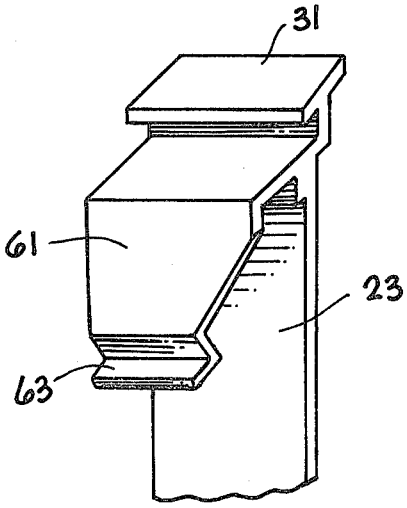
FIG. 4 is a perspective rear view of the upper extremity of the rear strut of the tape tab forming device of FIG. 2.

The upper portion of strut 23 is the upwardly inclined wing 31 which is connected to the downwardly extending leg 61 and the curved foot 63, more clearly seen in FIG. 4. The leg and foot are supported on opposite sides by anchor members of the tape roll holder.

I claim:

1. In combination, a dispenser of adhesive tape and a device for forming a tab in the tape, comprising, roll holder means for supporting a roll of the tape, said roll holder means having a forward upwardly extending tear-off station establishing a tape dispensing path, and a molded polymer one-piece tab forming device detachably connectable to said roll holder means in said tape dispensing path, said device having a pair of upwardly extending forward and rearward struts and a spring, said struts having upper and lower extremities, respectively, and being connected together at said lower extremities by said spring, said struts being biased by said spring to diverge upwardly whereby said extremities normally are in a spaced open position in the direction of said tape dispensing path, said forward strut being movable in the tape dispensing path toward said rearward strut against the bias of the spring to a closed position proximate to the tear-off station of the roll holder to thereby form a tab in said tape, said tear-off station of the roll holder means having integrally formed internally disposed anchor members, said rearward strut of said device extending into the interior of said tear-off station and detachably engaging said anchor means whereby to enable rapid coupling of the device to the dispenser without tools, said upper extremity of the forward strut having at least one integral tang on the side thereof between the struts and defining therewith a slot, and an inverted hook shaped member having one portion detachably engaged with said tang within the slot and extending forwardly over the upper extremity of the forward strut, the forward end of said member being serrated to provide a tape cutting edge.

* * * * *